US008288735B2

(12) United States Patent
Syage et al.

(10) Patent No.: US 8,288,735 B2
(45) Date of Patent: Oct. 16, 2012

(54) PHOTOEMISSION INDUCED ELECTRON IONIZATION

(75) Inventors: Jack A. Syage, Huntington Beach, CA (US); Andrey N. Vilkov, Tustin, CA (US)

(73) Assignee: Morpho Detection, Inc., Newark, CA (US)

( * ) Notice: Subject to any disclaimer, the term of this patent is extended or adjusted under 35 U.S.C. 154(b) by 0 days.

(21) Appl. No.: 13/091,365

(22) Filed: Apr. 21, 2011

(65) Prior Publication Data

US 2011/0278447 A1 Nov. 17, 2011

Related U.S. Application Data

(60) Provisional application No. 61/326,524, filed on Apr. 21, 2010.

(51) Int. Cl.
*H01J 49/10* (2006.01)
*H01J 27/20* (2006.01)

(52) U.S. Cl. ..... 250/423 R; 250/282; 250/299; 250/424; 250/461.1; 250/504 R; 313/541; 313/542; 324/464

(58) Field of Classification Search ..... 250/281, 250/282, 288, 299, 361 R, 362, 363.01, 365, 250/372, 389, 423 R, 42, 4, 427, 458.1, 459.1, 250/461.2, 504 R; 324/459, 464; 313/523, 313/541, 542

See application file for complete search history.

(56) References Cited

U.S. PATENT DOCUMENTS

| | | | | |
|---|---|---|---|---|
| 4,007,624 | A * | 2/1977 | Chantry et al. | 73/23.2 |
| 4,376,892 | A * | 3/1983 | Charpak et al. | 250/372 |
| 4,733,086 | A * | 3/1988 | Simmonds | 250/423 P |
| 7,351,981 | B2 * | 4/2008 | Austin | 250/373 |
| 2007/0181818 | A1 * | 8/2007 | Austin | 250/373 |

* cited by examiner

*Primary Examiner* — Bernard E Souw
(74) *Attorney, Agent, or Firm* — Armstrong Teasdale LLP

(57) ABSTRACT

A monitor that can detect at least one molecule. The monitor includes a housing with a passage that can receive a sample, and a photocathode that is located within the housing. The monitor also includes a first ultraviolet light source that can direct ultraviolet light onto the photocathode to create electrons that ionize molecules within the sample, and a detector that is coupled to the housing to detect at least one ionized molecule. The monitor enables electron ionization (EI) of a sample for chemical analysis without the disadvantages of current methods that use a hot filament or other thermal cathode devices.

18 Claims, 10 Drawing Sheets

PHOTOEMISSION INDUCED ELECTRON IONIZATION

CROSS REFERENCE TO RELATED APPLICATION

This application claims priority to Application No. 61/326,524 filed on Apr. 21, 2010.

BACKGROUND OF THE INVENTION

1. Field of the Invention

The present invention relates to the field of detection apparatuses used to screen for the presence of explosives and other chemical entities.

2. Background Information

Mass spectrometry (MS) is one of the most important analytical methods for analyzing samples and materials for chemical composition. A main component of a MS instrument is the ionization source. Ionization sources are also used for other analytical instrumentation such as ion mobility spectrometry (IMS). There are many types of ionization sources used in these instruments depending on the analysis applications, and also the methods and types of molecules that are being analyzed.

There has been new developments in ionization sources for MS instruments that are based on atmospheric pressure ionization (API). These type of sources are typically employed for MS analyses that use liquid chromatography (LC) for sample preparation and separation. The most common ionizers are electrospray ionization (ESI), atmospheric pressure chemical ionization (APCI) and atmospheric pressure photoionization (APPI). Recent developments have included developing multimode sources including some combination of these sources.

Whereas significant development of ionization sources has been made in recent years for LC-MS, very little new development has been made for the related analytical instrumentation of gas-chromatography (GC) MS (GC-MS). The ionizers for GC-MS typically occur at less than atmospheric pressure. The method of chemical ionization (CI) is based on introducing some external source of gaseous molecules (e.g., methane, methanol, ethanol, etc.) into a chamber in which a discharge is formed. These ions then transfer their charge to molecules that might be eluting from a GC column. The sample eluting from the GC column is vaporized due to the heat of the GC column and is therefore in gaseous form when entering the ionization volume, which for CI is at about 1 torr to optimize the discharge and charge transfer process.

The more common method of ionization for GC-MS is electron ionization (EI), which is based on creating a stream of electrons that are accelerated to some energy by electrical fields and crossing it with a sample that elutes from a GC column. The typical source of the electrons is a heated filament that when heated by passing a current through the wire causes thermionic emission of electrons. This process is essentially the same as what occurs in an incandescent light bulb. In order for the filament to have reasonable lifetime against burning out due to gaseous bombardment and oxidation, it must be in a vacuum region, typically less than $10^{-5}$ torr. The filaments can be coated with various materials (e.g., thorium) that increase the efficiency of thermionic emission of electrons allowing the filament to be operated at somewhat reduced temperatures, however, the tolerance to reduced vacuum conditions (i.e., higher pressures) is not significant. There are various types of devices that are referred to as cold cathodes that can improve on the tolerance of electron emitters to reduced vacuum conditions; however, again to achieve reasonable lifetimes, the pressures are on the order of $10^{-4}$ torr or less.

Because of the limitation of standard EI sources with pressure there have been some ion source designs that attempt to generate electrons at high vacuum and then focus them through slits into a tube or other chamber where the sample is maintained at higher pressure. These closed ion sources achieve a higher density of electrons and gaseous sample; however, the intensity of the electron beam is greatly reduced due to inefficiencies in the transmission through the slit.

The process of photoemission of electrons off of surfaces is generally known in the art and the explanation of the process was first revealed by Einstein in his Nobel Prize winning work on the photoelectron effect. Einstein showed that materials such as metals have work functions for electron detachment and that the energy of the electron E detaching from a material of work function W due to the impingement of a photon of energy hv is given by the simple equation $$E=h\nu-W$$

The condition for emitting an electron is therefore $h\nu \geqq W$. The typical value of W for metals and other photocathode materials is in the 4-5 eV range. The upper range corresponds to photons of wavelength about 250 nm.

The physical process of photoemission of electrons is used routinely in devices such as photodiodes and photomultiplier tubes. These devices measure the intensity of light by converting photons that hit the photocathode surface into electrons that can be measured by current measuring devices.

The development of photoemission as an ionization source; however, is not common. A few publications discuss methods based on directing a UV laser at a metal surface in vacuum to generate electrons that are then accelerated through a molecular beam to achieve ionization (Rohwer et al. 1988; Syage et al. 1989; Boyle et al. 1991; Boesl et al. 1994). However lasers are very complex and expensive and therefore not practical for a general purpose chemical analysis device. Furthermore the UV lasers are invariably pulsed lasers and therefore do not allow a continuous beam of electrons, which is desirable for most common methods of GC-MS analysis and direct sampling MS analysis.

There are very few developments of photoemission of electrons as an ionization source for MS, IMS, or any analytical method. U.S. Pat. No. 4,574,004 issued to Schmidt-Ott et al discloses a method for charging particles by irradiating with light that causes photoemission of electrons from the particle, but this does not use the resulting electrons as an ionization source. U.S. Pat. No. 5,461,280 issued to Kane discloses a method to enhance a cold-cathode emitter by irradiating the surface with photons thereby allowing electron emission with a lower applied potential electric field. However, this method does not address total electron flux, or use as an ionization source.

U.S. Pat. No. 4,713,548 issued to Kim discloses a photoelectron emitter comprising a UV light source and photocathode to create negative ions; however, this invention does not disclose or teach how to achieve positive ionization or a combination of ionizations. U.S. Pat. No. 7,196,325 issued to Syage discloses a photon source and photocathode for ionization in combination with a glow discharge source. However, this patent, nor any of the others referenced disclose or teach how to achieve a narrow energy electron beam, convenient replacement without disrupting the vacuum, integration with a GC sampling system, nor the combination of low and medium pressure operation along with the combination of PE-EI and PI.

SUMMARY OF THE INVENTION

A monitor that can detect at least one molecule. The monitor includes a housing with a passage that can receive a sample, and a photocathode that is located within the housing. The monitor also includes a first ultraviolet light source that can direct ultraviolet light onto the photocathode to create electrons that ionize molecules within the sample, and a detector that is coupled to the housing to detect at least one ionized molecule.

DETAILED DESCRIPTION

Figure 1B:
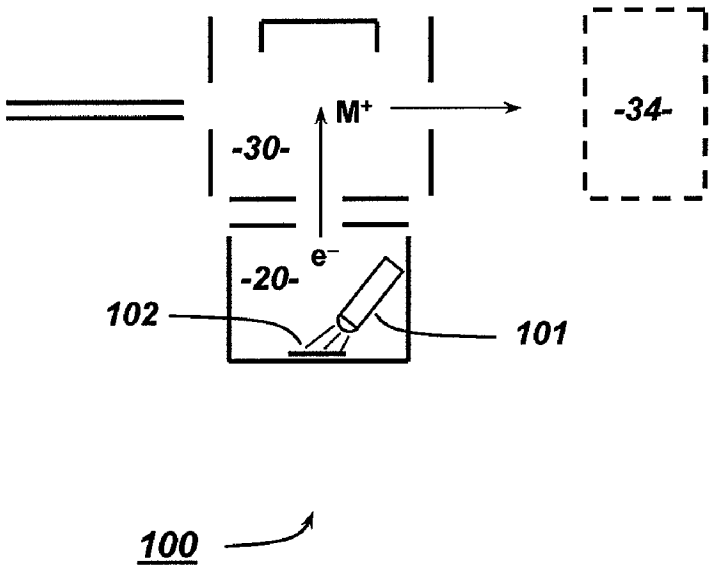
FIGS. 1A and 1B are illustrations showing a prior art monitor that ionizes molecules of a sample.

Disclosed is a monitor that can detect at least one molecule. The monitor includes a housing with a passage that can receive a sample, and a photocathode that is located within the housing. The monitor also includes a first ultraviolet light source that can direct ultraviolet light onto the photocathode to create electrons that ionize molecules within the sample, and a detector that is coupled to the housing to detect at least one ionized molecule. The monitor enables electron ionization (EI) of a sample for chemical analysis without the disadvantages of current methods that use a hot filament or other thermal cathode devices. The ionization device is especially useful for GC-MS instrumentation since it can provide highly fragmented ions, which are useful for structure analysis and for identifying molecules against an EI data base. However, it can also provide a high yield of unfragmented ions, which are important for the emerging application of GC-MS/MS, wherein instead of fragmenting in the initial ionization step, it is desirable to form parent ions that are then fragmented in a controlled manner through mass-selected ion collision in a buffer gas chamber.

What is described is a technology for EI that is much more tolerant of higher pressure conditions than conventional EI sources and can therefore operate at much higher sampling densities leading to much higher detection sensitivity. Furthermore, the light source can be mounted external to the vacuum system enabling replacement without venting the vacuum. Venting the vacuum of a MS or other analyzer requires a complete shutdown of pumps and electronics and the cycle time for venting, servicing, and pumping down to restore analysis conditions can be very long (i.e., several hours). The replacement of the light source in the disclosed monitor can be accomplished in just a few minutes. This is particularly desirable for in-field analysis and for real-time analysis, where down time can not be tolerated.

The disclosed monitor is advantageous over the prior art because; it can operate at much lower temperatures and can operate at much higher pressures leading to greater detection sensitivity; is not susceptible to oxidation so it can be used in analyzers that use direct air sampling; the energy distribution of the electrons from the photocathode surface is very narrower due to low temperature and a narrow photon energy bandwidth (<0.1 electron volts); allows for a large electron emitter surface that greatly reduces space charge effects that can limit electron flux at low emission energies; has a longer-life than typical filament light sources of the prior art; is easy to maintain because the light source can be mounted exterior to the vacuum; and can be turned on and off rapidly and evenly and can therefore be operated in either continuous or pulsed mode as well as modulated to extend the life by turning it on precisely when needed without requiring a warm up time.

The monitor may also combine photoemission electron ionization (PE-EI) with direct photoionization (PI), which have novel benefits for GC-MS and direct MS analysis. These benefits include; a capability to ionize a wider range of molecules; an option to use PE-EI to ionize and fragment molecules similar to conventional EI in order to obtain structure analysis and/or use PI for ionizing molecules with minimum fragmentation which is desirable for many MS analyses and particularly for hybrid MS/MS type analyses; and a capability to generate both positive and negative ions with the advantages stated above.

Figure 1A:
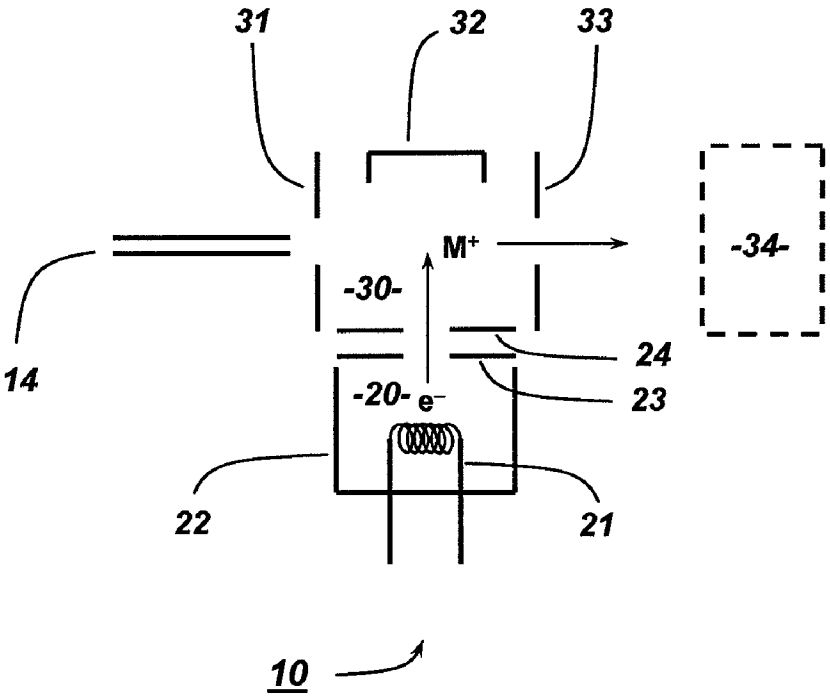
FIG. 1A Prior Art

Referring to the drawings more particularly by reference numbers, FIG. 1A shows the basic configuration of a conventional EI source 10 that uses a hot filament to generate electrons by thermionic emission. The source 10 consists of a filament 21, a housing 22 maintained at some voltage, an electrostatic gate lens 23 that is at a switched voltage to allow electrons to exit or not, an electrostatic lens 24 at some voltage. The filament 21 is normally set to the same or similar voltage as the housing 22 so that the electron energy exiting lens 24 has an energy given approximately by the difference in the voltage applied to the housing 22 and lens 24. The electrons pass through the ionization region 30 and impact a lens plate 32. The electrons cross through a sample that exits from the sample inlet 14. Electrons can impact molecules to create ions such as $M^+$, which are then typically propelled by electrostatic lenses such as 31 and 33 to a detector 34.

FIG. 1B illustrates the basic embodiment of monitor with a photoemission electron ionization (PE-EI) source 100 that includes an ultraviolet (UV) light source 101 and a photocathode surface 102. The light source 101 emits ultraviolet light that hits the photocathode 102 to create electrons. The photoemission electrons can then be accelerated into the ionization volume 30 by the same means described above for the prior art source 10.

Figure 2B:
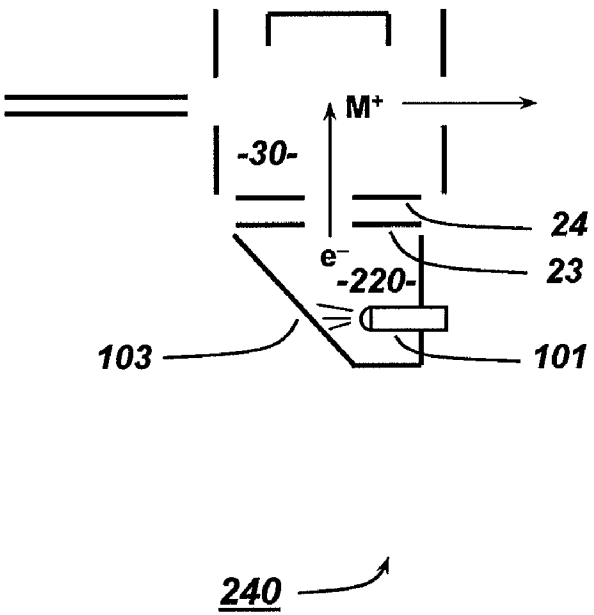
FIGS. 2A and 2B are illustrations showing different arrangements for a monitor of the present invention.
Figure 2A:
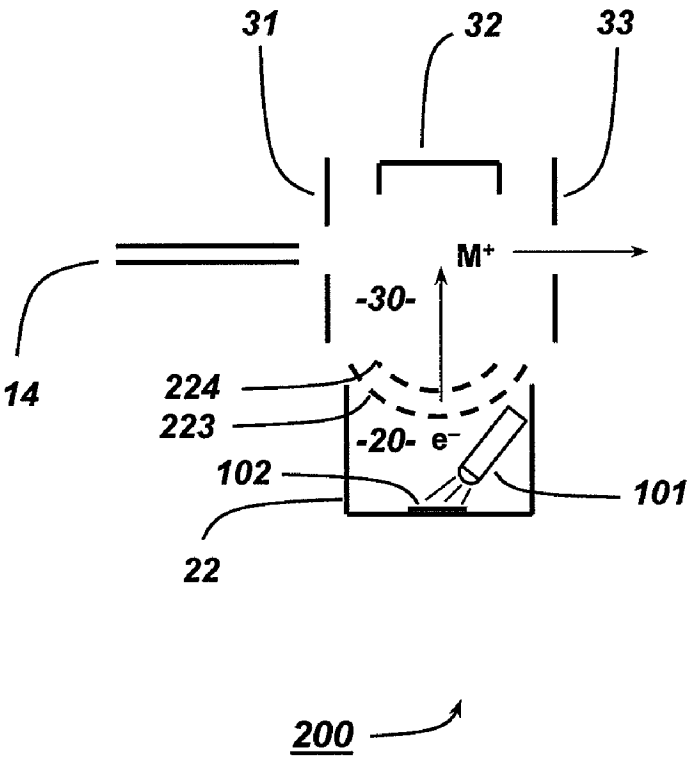

FIGS. 2A-C illustrate a variety of configurations and operation of a PE-EI source. FIG. 2A shows a source 200 that is similar to the source 100 in FIG. 1B except that the gate and acceleration electrostatic lenses 223 and 224, respectively are curved allowing the electrons to be focused to the center of the ionization volume 30. This may be desirable because depending on the divergence of the light for the UV source chosen and the distance from the photocathode surface, the photoemitted electrons may be spatially dispersed. For some applications it is desirable to spatially disperse the photoemitted electrons in order to maximize the total flux of electrons coming off the surface. FIG. 2B shows an ionization source 240 that uses a slanted surface 103 for the emission of electrons.

Figure 3B:
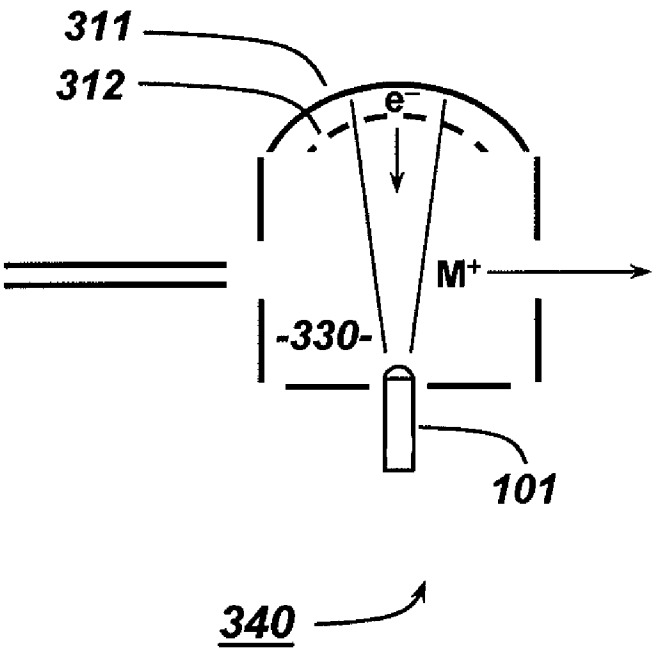
FIGS. 3A and 3B are illustrations of an embodiment where photoemitted electrons are generated on the opposite side of an ionization volume.
Figure 3A:
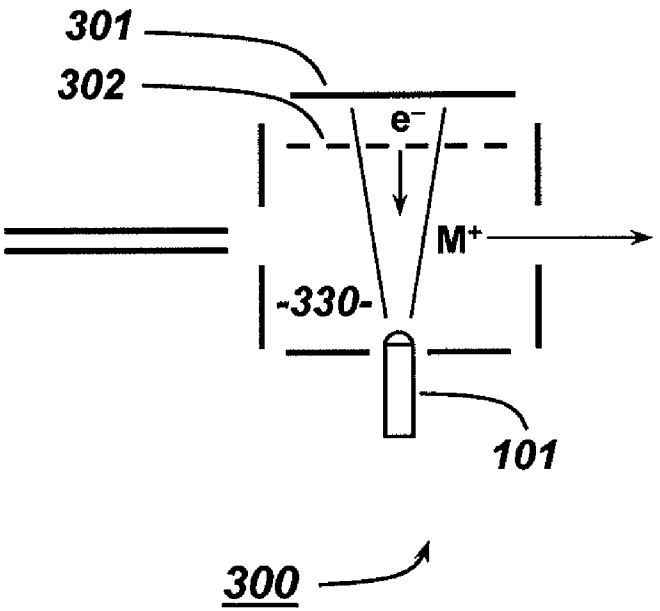

FIGS. 3A and 3B illustrate an embodiment in which the light source 101 irradiates a photocathode surface 301 on the opposite side of an ionization volume 330. FIG. 3A shows an arrangement in which the photocathode surface 301 and the electrostatic lens 302 are planar. The electron energy is given by the voltage difference between 302 and 301. FIG. 3B shows a similar arrangement except that the photocathode surface 311 and electrostatic lens 312 are curved in order to achieve a focusing of the photoemitted electrons to the center of the ionization volume 330.

Figure 4B:
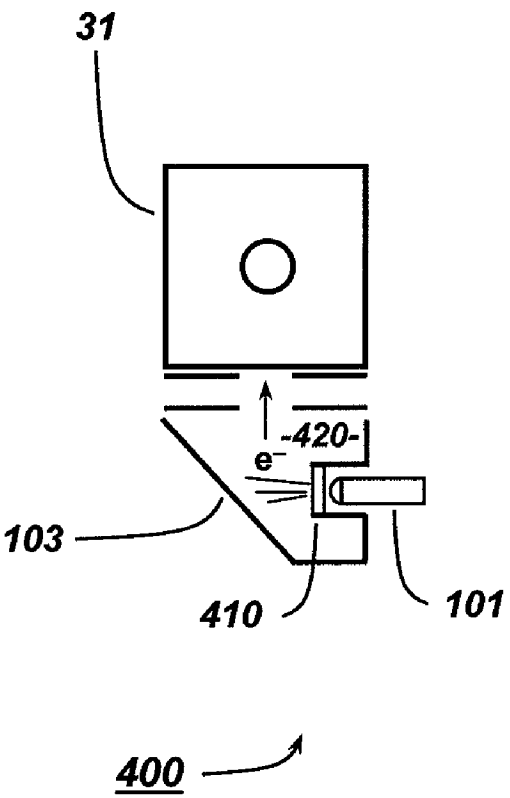
FIGS. 4A and 4B are illustrations of an embodiment in which the light source is mounted outside of a vacuum chamber.
Figure 4A:
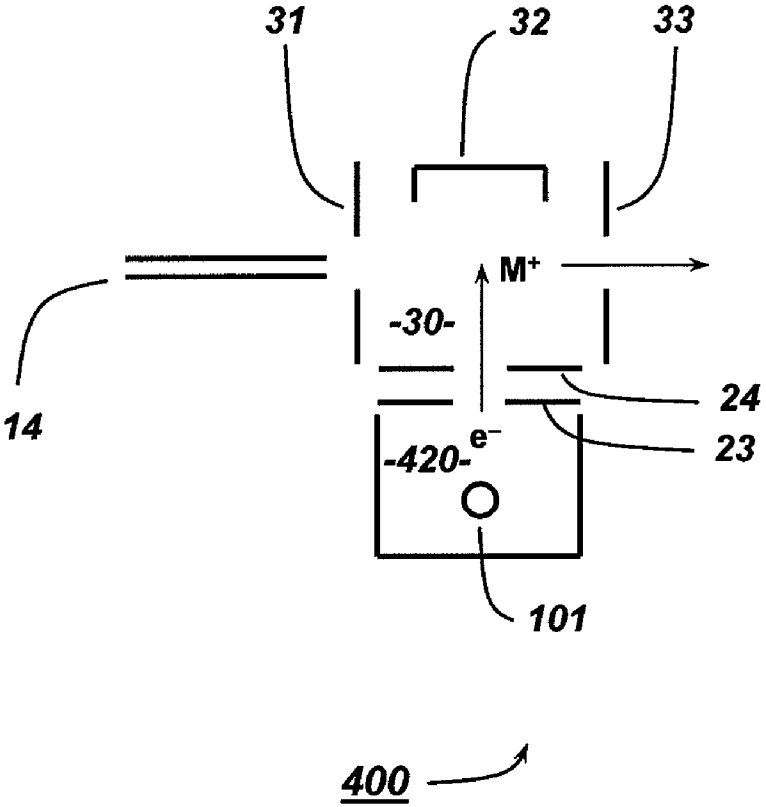

FIG. 4 illustrates an embodiment in which the light source can be mounted outside the vacuum chamber. This embodiment is particularly useful if the detection system is based on mass spectrometry or another chemical analyzer that requires vacuum. With this embodiment the ionization source can be replaced if necessary without venting vacuum, which enables operation to be restored in a matter of minutes rather than hours as discussed above. FIG. 4A shows the configuration in which the light source 101 is mounted orthogonal to the path of the sample inlet 14, the ionization volume 30 defined by the electric field gradient across electrodes 31 and 32 and the final path of the ions $M^+$ to the detector. FIG. 4B shows a view of this embodiment rotated 90 degrees. The light source 101 is shown mounted exterior to the electron source region 420 and the UV light travels through a UV transmission window 410. This window material can be any of several standard materials such as quartz silica or sapphire.

One of the main attributes of the disclosed photoemission EI source is the capability to operate the electron source at pressures much higher than is typical for standard filament or cold cathode EI devices. This enables operation at sample pressures more than a few orders of magnitude higher and this can lead to a proportionately higher yield of ions for detection. As discussed above, the typical pressure under which conventional EI sources operate is about $10^{-4}$ to $10^{-6}$ torr due to the deterioration of these sources in the presence of atmospheric gases and particularly oxygen. The photoemission light sources that are disclosed here do not have such pressure limitation, which enables embodiments that can achieve very high sensitivities not achievable by conventional EI sources.

Figure 5A:
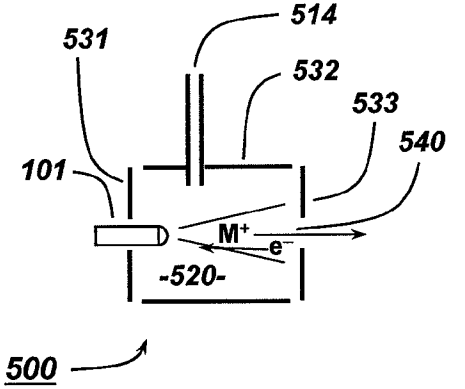
FIGS. 5A-C are illustrations showing different arrangements of an embodiment of a monitor that operates at higher pressure.
Figure 5B:
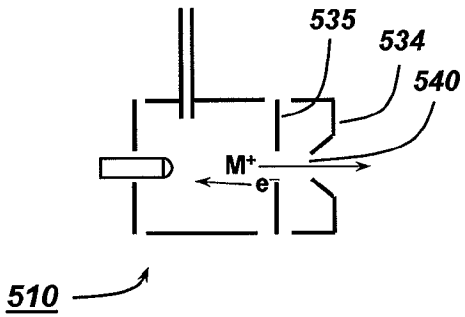
Figure 5C:
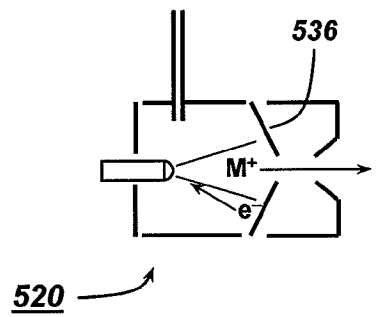

FIGS. 5A-C illustrate a variety of embodiments for higher pressure PE-EI. FIG. 5A shows a simple ionization source 500 in which the sample inlet 514 fills an ionization region 520. The light source 101 emits light that impinges on the electrostatic lens 533, that also serves as the photocathode material. Further electric fields are achieved by the housing lens 532 and the back lens 531. By applying the appropriate electric field gradient across these lenses so that the voltage gradient declines from lens 531 to 533, one can effect the acceleration of electrons from lens 533 to 531 creating EI of sample eluting from inlet 514. The positively charged molecules formed, such as $M^+$ will be accelerated in the opposite direction from the electrons in the direction of lens 533 and exit the aperture 540 and toward an analyzer such as a mass spectrometer.

FIG. 5B shows an embodiment of an ionization source 510 that has two stages of ion acceleration. The utility of this source is the capability to contain the ions within the ion source and optimize the EI process in the first region and provide for a second region of ion acceleration defined by electrodes 534 and 535 that can be optimized to direct molecule ions out of the ion source aperture 520 and toward an analyzer. FIG. 5C shows a variation of this embodiment in which the source 520 has slanted electrodes 536 to provide a focusing effect of the photoemitted electrons toward the centerline of the ion source to achieve better ionization efficiency and better transmission efficiency of the formed ions out of the ion source aperture 540.

Figure 6A:
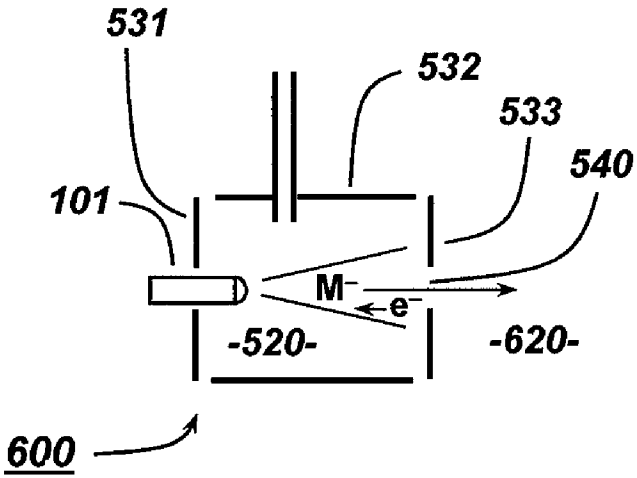
FIGS. 6A and 6B are illustrations of embodiments that can achieve negative ionization of photoemitted electrons.
Figure 6B:
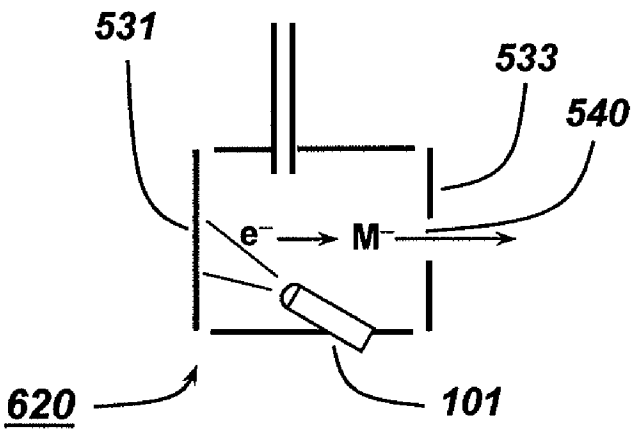

FIGS. 6A and 6B show embodiments of the higher pressure PE-EI source configured for negative ionization. The ionization source 600 in FIG. 6A is very similar to the ionization source 500 in FIG. 5A except that the voltages applied to electrostatic lenses 531 and 533 will be such that the electric field gradient will be lower in order to reduce the electron energies and maximize the process of electron attachment to form negative ions. The lower electric field will also allow negative ions to exit aperture 540. Due to the higher pressure in ionization region 520 compared to the analyzer region 620, negative ions may stream out of the aperture 540 even if the electric field gradient is negative from lens 531 to lens 533. In this case both positive and negative ions may stream out together.

FIG. 6B shows a configuration in which photoemitted electrons are created on the surface of electrode 531 The advantages of this configuration is that the flow of electrons and negative ions is in the same direction and follows the desired electric field gradient across electrodes 531 and 533. With this embodiment it is not necessary to rely on the pressure flow through aperture 540 to carry ions out. This configuration also has the advantage of impeding the flow of positive ions through aperture 540 since they will be drawn to electrode 531 due to the lower voltage on 531 versus 533.

Figure 7C:
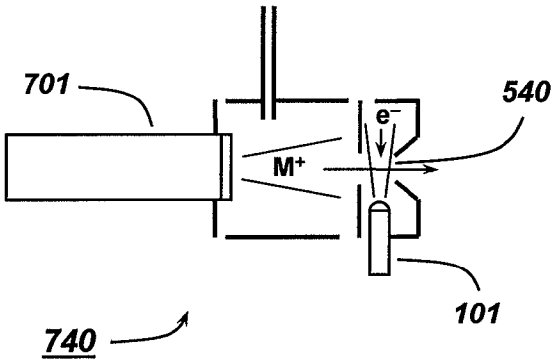
FIGS. 7A-C are illustrations of embodiments that can achieve both photoemission EI and photoionization.
Figure 7A:
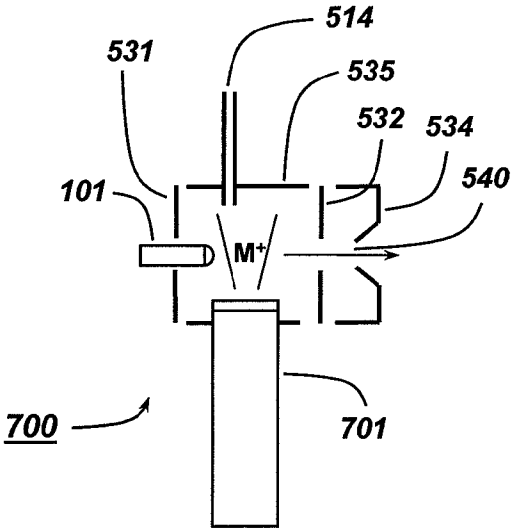

FIG. 7A illustrates a multimode source 700 that contains provisions of PE-EI using light source 101 and for direct PI using light source 701. These light sources can generate different types of ions and therefore may offer selectivity in the types of molecules that are detected. For example the PI light source 701 will only ionize molecules whose ionization potential is below the photon energy of source 701. By way of example light source 701 could be a low pressure krypton discharge source that emits photons at 10.0 and 10.6 eV. Only molecules that have ionization potentials below 10.6 will be ionized and observed. This is beneficial for air sampling by avoiding ionizing of the most common air molecules (e.g., $N_2$, $O_2$, $H_2O$, $CO_2$, CO, Ar, etc.).

Figure 7B:
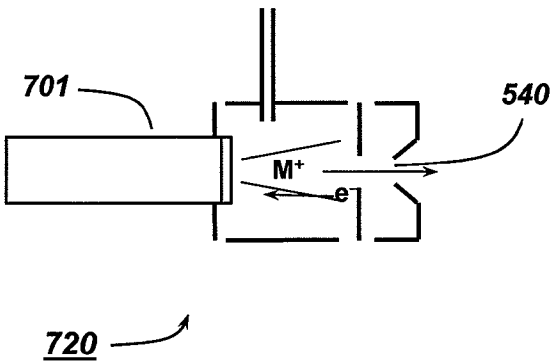

FIG. 7B shows an embodiment of an ion source 720 that can have a similar capability to ion source 700. In this embodiment the vacuum UV (VUV) light source 701 can achieve both direct PI as well as PE-EI. However, the total number of available photons for light source 701 may be significantly lower than for light source 101, so that the PE-EI efficiency will not be as high with the single light source configuration 720. However, the ion source may be more simple than ion source 700, which could be desirable for certain applications and where economy of the instrument is important.

FIG. 7C shows an embodiment of an ion source 740 that has both the UV light source 101 and VUV light source 701, but mounted in different regions of the ion source.

The two ionization mechanisms PE-EI and PI that can be achieved in ion sources 700, 720, and 740 can be operated simultaneously to maximize the number and types of molecules that can be detected; or it can operate in one or the other mode depending on the application; or it can operate in rapidly switching mode. Other modes of operation can also be performed, particularly including detection of positive and negative ions.

Figure 8A:
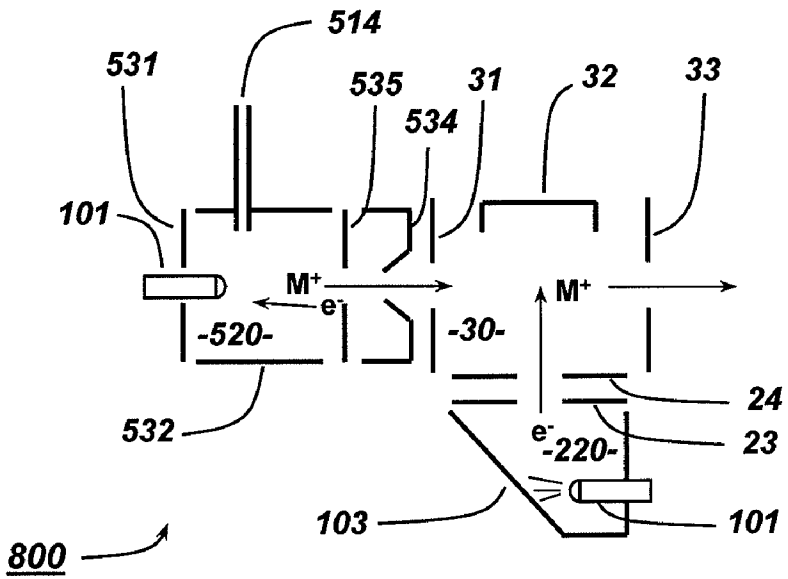
FIGS. 8A and 8B are illustrations of embodiments showing monitors operating at different sample pressures.
Figure 8B:
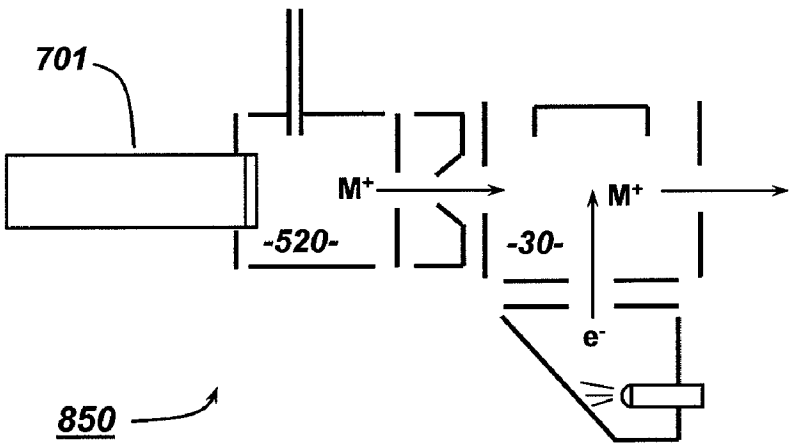

FIGS. 8A and 8B shows other multimode embodiments. FIG. 8A shows a combination ion source 800 that basically merges ion source 510 in FIG. 5B with ion source 240 in FIG. 2B. The source 800 is shown by way of example. Other combinations of higher pressure sources such as 500, 510, 520, 600, and 620 can be combined with lower pressure ion sources 100, 200, 240, 300, 340, and 400.

FIG. 8B shows an embodiment of a combination multimode ion source 850 that combines the higher pressure PI source 750 in FIG. 7B using light source 701 with the lower pressure ion source 240. This combination is complementary because direct PI ions are formed in ionization region 520 and PE-EI type ions are formed in ionization region 30. The PE-EI ions can be primarily highly fragmented, which is desirable for GC-MS analysis whereas the PI ions can be primarily parent ions with minimum ion fragmentation, which is desirable for GC-MS/MS experiments.

As discussed above for the multimode sources 700, 720, and 740 in FIGS. 7A-7C, the multimode sources 800 and 850 in FIG. 8 can operate in simultaneous mode, in one or the other mode, or in rapid switching mode. Other modes of operation can also be performed, particularly including detection of positive and negative ions.

Figure 9:
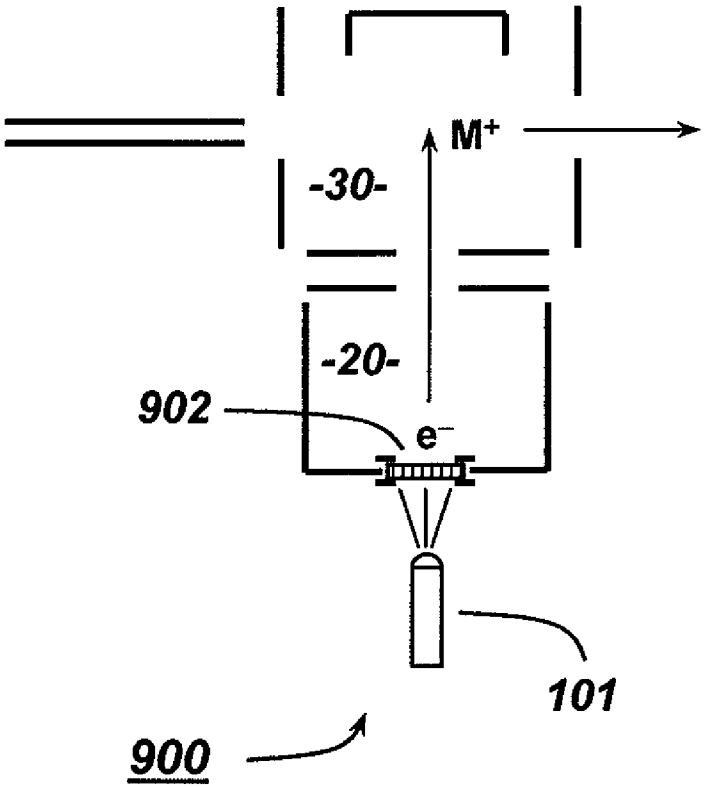
FIG. 9 is an illustration of an embodiment in which the photoemission light source impinges on an electron amplifier device; and, FIG. 10 is a graph showing mass spectra of toluene, acetylnitrile, and methanol in air recorded for a device that can operate in both PE-EI and in PI mode.

FIG. 9 shows an embodiment 900 in which the light source 101 impinges onto a device that photoemits electrons and then amplifies the electrons through a charge amplification process. This can be a glass or similar material with multiple perforation channels and an electric field applied across it to accelerate electrons into the channels to generate additional electrons. Such a device is often called a microchannel plate, but other devices can also be used including devices with chevron structures. The use of this amplified photoinduced electron emission source can be used for the previously described embodiments.

Figure 10:
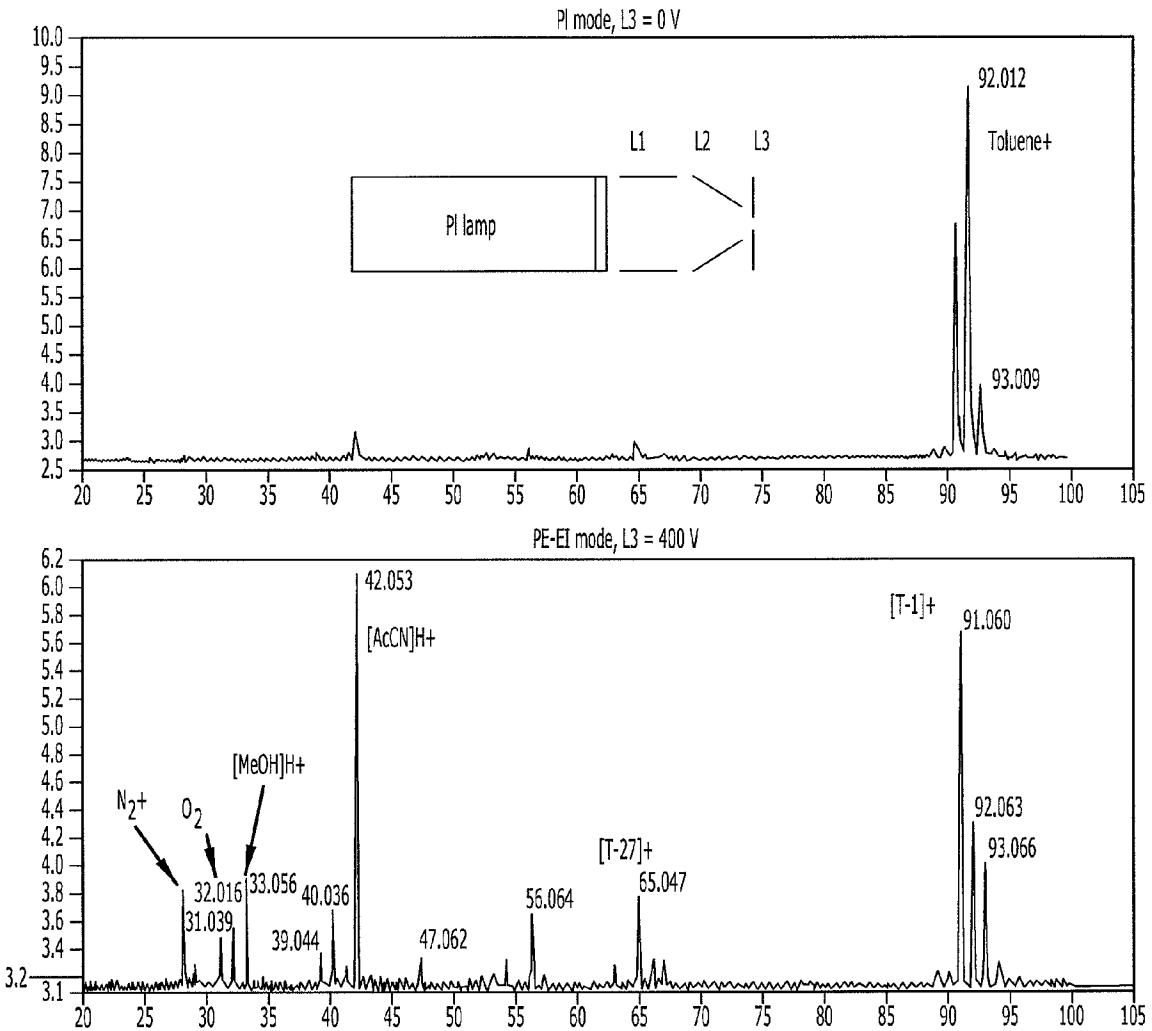

FIG. 10 shows plots of mass spectra resulting from a higher pressure ion source similar to 750 in FIG. 7B. The PI lamp is a VUV Kr discharge light source. Direct PI does not require any electric fields on electrodes L1, L2, and L3 other than to provide a focusing field to concentrate the ions through the aperture in L3. However, at the pressure of the PI source of about 1 torr, the flow of molecules generally sweeps the ions out of the aperture without the need for strong electric fields. For direct PI L1, L2, and L3 were all set to 0V. A sample was introduced that contained low level vapors of toluene, acetonitrile, and methanol in air. Only toluene has an ionization potential below the VUV photon energies of 10.0 and 10.6 eV. As seen in the top graph of FIG. 10, only toluene ion is seen consisting of the molecular ion $T^+$ and a smaller signal due to loss of one hydrogen $[T-1]^+$. This is a typical signal and ion distribution for PI.

The bottom graph in FIG. 10 shows the results when L3 is set to 400 V. This gives a spectrum that looks like an EI spectrum. Acetonitrile and methanol ions are now seen (as protonated molecular ions) as are $N_2^+$ and $O_2^+$. Since these molecules do not ionize by PI, the mechanism occurring here is PE-EI. At L3=400 V, photoemitted electrons are now accelerated to energies that are sufficiently high to achieve EI. It is further noted that the ion distribution for toluene now shows that the signal intensity is greater for $[T-1]^{30}$ than for $T^+$ as is observed in EI spectra.

We now consider properties of the light source and photocathode material that can be used to construct a PE-EI source for the various embodiments described above. For photocathodes with work functions of 4-5 eV, photon energies around 250-300 nm may be desired. There are several options for light sources in this region, the most common being 266 nm lasers (Nd:YAG, $4^{th}$ harmonic) and 254 nm mercury lamps (hot-cathode plasma discharge). However, lasers are expensive and complex and the mercury lamps are bulky and cannot provide directed UV light. Although some mercury lamps are equipped with light guides allowing directed UV light with outputs on the order of $\geqq 1$ W/cm$^2$. Another option is recently commercialized deep UV light emitting diodes (LEDs). The advantage of LEDs are small size, robustness, digital control, instant on/off, low voltage, and no hazardous waste.

By way of example we will consider as a reference source a commercially available LED that emits at 260 nm (Gaussian distribution from 255 to 264 nm) and provides directed UV output of 300 μW for continuous operation and 10 mW in pulsed mode. A ball lens can be installed to focus the light to a 1.5-2 mm spot if desired. Other options include near UV LEDs, such as at 365 nm (±5 nm), which provide radiant outputs in the range of 0.1-10 W/cm$^2$. However, this wavelength corresponds to energy of 3.4 eV and therefore the photocathode material chosen would need to have a work function less than that value.

Photocathode materials may range from standard metals to exotic inorganic compositions used in photodiode and photomultiplier detectors. Metals such as stainless and copper have quantum efficiency $\phi$ values of about $10^{-4}$ electrons/photon. Molybdenum has a $\phi$ value of about 0.05. Materials such as CsI, CsTe, Ki, and KBr have $\phi$ values in the UV of about 0.5.

The electron photoemission current that can be achieved by the disclosed devices can be estimated through the following analysis. The current is given by:

$$I=P\times\phi\times q/h\nu$$

Where I is current in amps, P is radiant power in watts, $\phi$ is photocathode quantum efficiency in units of electrons per photon, q is the charge of an electron, and hν is the energy of the photon. The table below shows calculated photoemission currents for various values of radiant power and quantum efficiency and assumes a photon energy of 255 nm, which is 4.86 eV/photon.

| | | I (μA) | | |
|---|---|---|---|---|
| $\phi$ | P (mW) | 0.3 | 10 | 300 |
| 0.0001 | | 0.006 | 0.2 | 6 |
| 0.0010 | | 0.056 | 1.9 | 56 |
| 0.0100 | | 0.564 | 18.8 | 564 |
| 0.1000 | | 5.641 | 188.0 | 5,641 |
| 0.5000 | | 28.204 | 940.1 | 28,204 |

Standard EI sources used in MS systems, such as for GC-MS analysis typically operate at emission currents of about 1-1000 μA. The table above shows that comparable to greater emission current can be achieved by the disclosed invention using typical UV light sources and photocathode materials.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed:

1. A monitor that can detect at least one molecule, comprising:

a housing with a passage that can receive a sample;

a photocathode located within the housing;

a first ultraviolet light source that can direct ultraviolet light onto the photocathode to create electrons that ionize molecules within the sample; and, a detector coupled to said housing to detect at least one ionized molecule.

2. The monitor of claim 1, wherein said housing includes a first chamber where the electrons are created and a second chamber where the sample is ionized.

3. The monitor of claim 1, wherein said housing includes a chamber where the electrons are created and the sample is ionized.

4. The monitor of claim 3, wherein the ultraviolet light travels across said chamber and strikes said photocathode.

5. The monitor of claim 1, further comprising at least one electrode that creates a voltage potential that moves the electrons.

6. The monitor of claim 5, wherein the electrode is curved.

7. The monitor of claim 1, wherein said photocathode is located at an oblique angle relative to said first ultraviolet light source.

8. The monitor of claim 1, wherein said photocathode is curved.

9. The monitor of claim 1, wherein said housing includes a window and said first ultraviolet light source is attached externally to said housing and the ultraviolet light travels through said window.

10. The monitor of claim 1, wherein negative ions are formed.

11. The monitor of claim 10, further comprising at least one electrode that causes the electrons and ionized molecules to move in a same direction.

12. The monitor of claim 1, further comprising a second light source that emits light at a different energy level than the ultraviolet light emitted by the first ultraviolet light source.

13. The monitor of claim 12, wherein the second light source is a ultraviolet light source.

14. A method for detecting a molecule in a sample, comprising:

directing ultraviolet light onto a photocathode to create electrons;

ionizing molecules of a sample with the photoemitted electrons; and, moving the ionized molecules to a detector to detect at least one ionized molecule.

15. The method of claim 14, wherein the photoemitted electrons are accelerated to energies that ionize the molecules by electron ionization.

16. The method of claim 14, wherein the electrons attach to the molecules to form negative ions.

17. The method of claim 14, further comprising varying the energy of the photoemitted electrons to vary fragmentation of the ionized molecules.

18. The method of claim 14, further comprising increasing an electron flux with an electron amplifier.

* * * * *